United States Patent [19]

Boteler

[11] Patent Number: 4,636,017

[45] **Date of Patent: * Jan. 13, 1987**

[54] FLAT CONDUCTOR CABLE

[75] Inventor: William C. Boteler, Bridgeport, Conn.

[73] Assignee: Harvey Hubbell Incorporated, Orange, Conn.

[ * ] Notice: The portion of the term of this patent subsequent to Jul. 29, 2003 has been disclaimed.

[21] Appl. No.: 771,149

[22] Filed: Aug. 29, 1985

Related U.S. Application Data

[63] Continuation of Ser. No. 616,155, Jun. 1, 1984.

[51] Int. Cl.[4] ..... H01R 4/24; H01R 11/01; H01B 7/36

[52] U.S. Cl. ..... 339/17 F; 174/112; 174/117 FF; 339/97 P

[58] Field of Search ..... 174/112, 117 F, 117 FF, 174/117 A, 117 R, 36; 339/17 F, 113, 176 MF, 97 P

[56] References Cited

U.S. PATENT DOCUMENTS

| | | | |
|---|---|---|---|
| Re. 31,336 | 8/1983 | Weinmann et al. | 29/868 |
| 2,079,274 | 5/1937 | Baker | 247/39 |
| 2,611,800 | 9/1952 | Naughton | 173/334.1 |
| 2,628,998 | 2/1953 | Frisbie | 174/112 |
| 2,749,382 | 6/1956 | Lockard | 174/71 |
| 3,079,458 | 2/1963 | Hedstrom | 174/117 FF |
| 3,168,617 | 2/1965 | Richter | 174/117 |
| 3,253,085 | 5/1966 | Stern | 174/117 |
| 3,408,453 | 10/1968 | Shelton, Jr. | 174/68.5 |
| 3,474,188 | 10/1969 | Travis | 174/117 FF |
| 3,511,680 | 5/1970 | Marcell et al. | 174/117 FF |
| 3,524,921 | 8/1970 | Wolf | 174/70 |
| 3,576,941 | 5/1971 | Colglazier | 174/117 |
| 3,715,457 | 2/1973 | Teagno et al. | 174/88 R |
| 3,720,747 | 3/1973 | Anderson et al. | 174/112 |
| 3,763,307 | 10/1973 | Wolf | 174/117 FF |
| 3,808,456 | 4/1974 | Kay et al. | 307/140 |
| 3,824,529 | 7/1974 | Dorrell | 339/17 F X |
| 4,045,750 | 8/1977 | Marshall | 333/6 |
| 4,219,928 | 9/1980 | Kuo | 29/868 |
| 4,240,687 | 12/1980 | Bunnell et al. | 339/99 R |
| 4,240,688 | 12/1980 | Sotolongo | 339/122 F |
| 4,249,303 | 2/1981 | Weinmann et al. | 29/868 |
| 4,256,359 | 3/1981 | Storck | 339/97 C |
| 4,258,974 | 3/1981 | Kuo et al. | 339/97 R |
| 4,283,593 | 8/1981 | Piasecki et al. | 174/36 |
| 4,289,370 | 9/1981 | Storck | 339/125 R |
| 4,315,662 | 2/1982 | Greenwood et al. | 339/97 C |
| 4,319,075 | 3/1982 | Willette | 174/117 FF |
| 4,348,548 | 9/1982 | Grundfest | 174/117 FF X |
| 4,371,225 | 2/1983 | Narozny | 339/97 C |
| 4,381,420 | 4/1983 | Elliott et al. | 174/34 |
| 4,387,949 | 6/1983 | Haitmanek | 339/125 R |
| 4,417,096 | 11/1983 | Willette | 174/71 R |
| 4,537,458 | 8/1985 | Worth | 339/17 F X |

FOREIGN PATENT DOCUMENTS

| | | | |
|---|---|---|---|
| 1910389 | 10/1969 | Fed. Rep. of Germany | 339/17 F |
| 1808453 | 1/1971 | Fed. Rep. of Germany | 339/71 F |
| 260837 | 11/1926 | United Kingdom | 174/112 |
| 403688 | 12/1933 | United Kingdom | 174/117 F |
| 963629 | 7/1964 | United Kingdom | 174/117 FF |

*Primary Examiner*—Arthur T. Grimley
*Assistant Examiner*—Morris H. Nimmo
*Attorney, Agent, or Firm*—Jerry M. Presson; Walter C. Farley

[57] ABSTRACT

A flat cable system includes a flat cable of a first type which has equally spaced flat conductors in a body of insulating material. A cable of a second type has three conductors, the centers of two of which are separated by the same spacing as in the cable of the first type but the third conductor is separated from the second by twice the spacing. A cable of a third type has three conductors which are uniformly spaced by the same center-to-center spacing as in the first type. When the cables are used together, the proper conductors are easily aligned for interconnection by using a reference edge adjacent the first conductor in each cable. The conductors are also color-coded.

5 Claims, 6 Drawing Figures

FLAT CONDUCTOR CABLE

This is a continuation of Ser. No. 616,155, filed June 1, 1984.

This invention relates to flat cable of the type having flat conductors therein and intended for electrical power distribution and, particularly, to an arrangement of conductors which facilitates interconnection thereof.

BACKGROUND OF THE INVENTION

Flat cable wiring systems have come into existence in recent years and are usable under certain conditions specified in the National Electrical Code (NEC). Such cable is defined in the code as type FCC. The NEC does not specify a maximum number of conductors that can exist in type FCC cable but does specify that there shall be three or more. Furthermore, the NEC requires that in any type FCC 2-wire system with grounding the grounding conductor must be central. This has been interpreted by certifying agencies to require that the grounding conductor of a type FCC 3 or 4 wire cable be located intermediate the outermost conductors.

Prior flat cable systems have not adequately provided transition assemblies which are capable of interconnecting type FCC cables with other forms of wiring systems and also with other FCC cables in a way which is fully satisfactory. In particular, those systems which are capable of, for example, connecting a 4-conductor FCC cable to one or more 3-conductor branch circuit FCC cables use 4-conductor cable for all of the cables. The selection of conductors to be interconnected at a transition point then depends upon the manner in which the interconnection device is assembled or used. The result is that in a branch circuit cable of a 2-wire grounded system, one of the conductors in a 4-conductor cable is simply not used.

BRIEF SUMMARY OF THE INVENTION

An object of the present invention is to provide types of flat cable which conform to NEC requirements and which are capable of branch circuit interconnection but which minimize the likelihood of erroneous interconnection.

A further object is to provide such cable types which reduce the amounts of copper used in branch circuit cables by as much as 25%.

A still further object is to provide such cable for use with a transition assembly where the cable has a reference edge alignable with a reference surface of the transition assembly regardless of the number of conductors in the cable.

In order that the manner in which the foregoing and other objects are attained in accordance with the invention can be understood in detail, particularly advantageous embodiments thereof will be described with reference to the accompanying drawings, which form a part of this specification, and wherein.

DETAILED DESCRIPTION OF PREFERRED EMBODIMENTS

Figure 1:
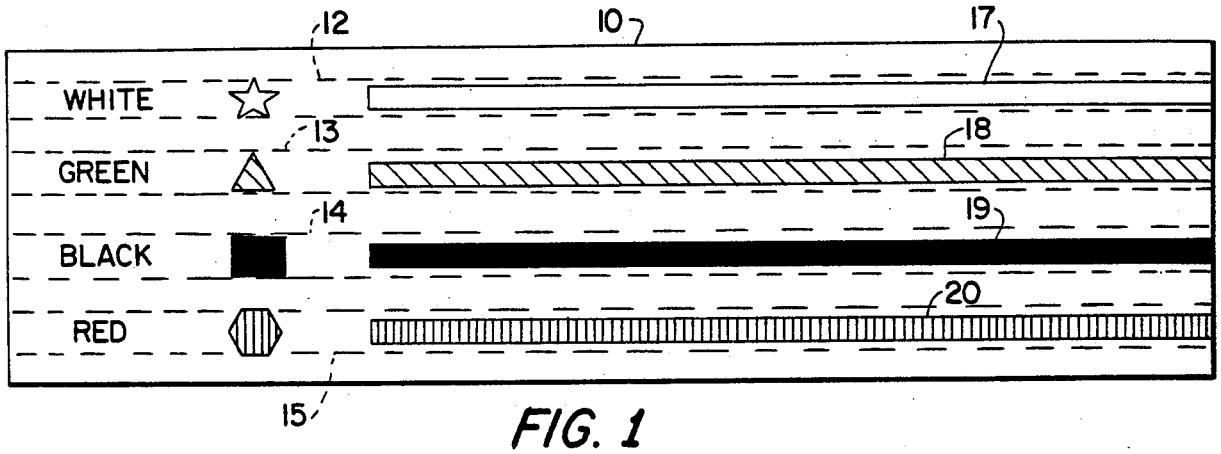
FIG. 1 is a plan view of a relatively short length of a flat cable of a first type.

As seen in FIG. 1, the cable of the first type includes a body of insulating material 10 which contains four elongated, flat conductive bodies 12, 13, 14 and 15 which are normally copper conductors. For a cable intended for 20-amp use and 12 AWG rating, each conductor is approximately 0.400 inches in width and 0.012 inches in thickness. The insulating material can conveniently be white vinyl layers bonded together between the conductors. The overall width of the cable of FIG. 1 is 2.5 inches.

As illustrated, the cable is provided with indicia stripes 17, 18, 19 and 20 identifying the conductors beneath those stripes by the standard color coding of white, green, black and red, the symbols and printed words also being used to guarantee proper identification.

Figure 2:
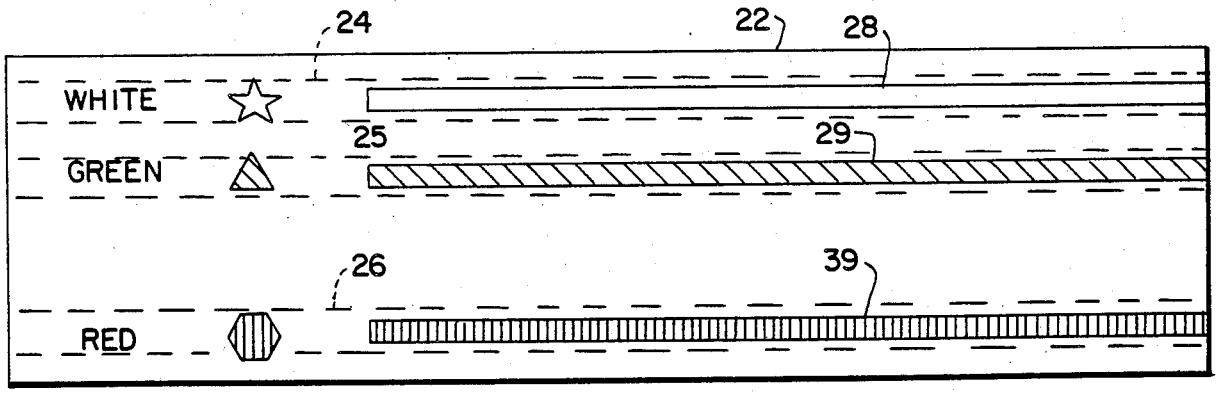
FIG. 2 is a plan view of a section of cable of a second type in accordance with the invention.

A second type of cable is illustrated in FIG. 2, this cable having a body of insulating material 22 with conductors 24, 25 and 26 embedded therein. The conductors being dimensioned as the cable of FIG. 1. Also, the cable of FIG. 2 has indicia stripes 28, 29 and 30, identifying the three conductors therein as being white, green and red.

It will be noticed, however, that the conductors of the cable of FIG. 1 are uniformly spaced apart, the center-to-center separation between two adjacent conductors being the same in each case. In the cable of FIG. 2, the white and green conductors 24 and 25 are separated by the same spacing as the conductors of the cable of FIG. 1, but the red conductor 26 is separated from the green conductor 25 by a center-to-center distance which is twice that of the type of FIG. 1 and twice the distance between centers of the white and green conductors 24 and 25.

Figure 3:
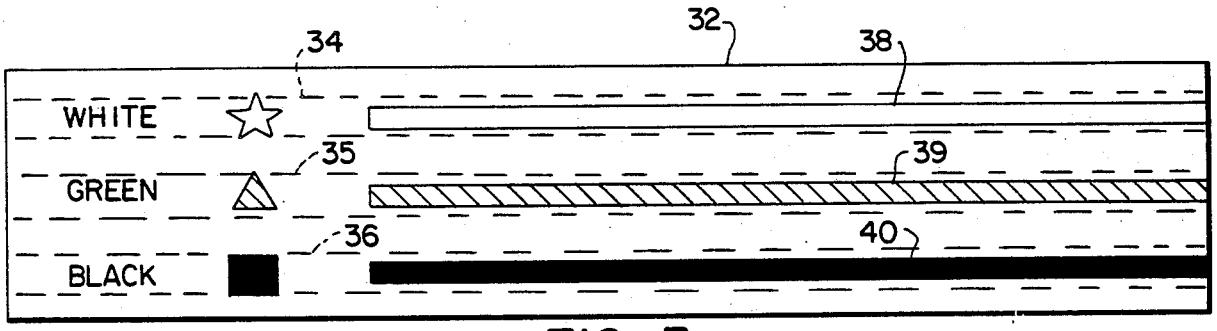
FIG. 3 is a plan view of a flat cable of a third type in accordance with the invention.

FIG. 3 shows a cable of a third type which also includes a body of insulating material 32 having conductors 34, 35 and 36 therein and indicia stripes 38, 39 and 40. It will be observed that the center-to-center spacing of conductors 34, 35 and 36 is uniform and the same as the equivalent spacing between conductors in FIG. 1.

Figure 4:
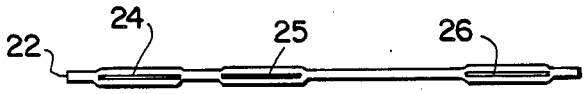
FIGS. 4 and 5 are left end elevations of the cables of FIGS. 2 and 3, respectively.
Figure 5:
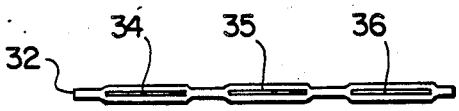

The conductors of FIGS. 3 and 2 are illustrated in end view in FIGS. 4 and 5, respectively in which it will be more clearly seen that the region between conductors 25 and 26 in FIG. 4 is simply a region of polymeric material with no conductor therein.

It will be readily apparent from this brief description that the cables of FIGS. 1, 2 and 3 can be spliced or interconnected together to form branch circuits by simply aligning the appropriate portions of the cables with each other, forming an opening through the conductors in the cables which are to be interconnected, and inserting some kind of device for forming an electrical connection therebetween. It will further be apparent that if the edge which is uppermost in each of FIGS. 1, 2 and 3 is used as a reference edge R, and if the reference edges of the cables to be interconnected are placed against a reference surface, the conductors in the cable will automatically be properly aligned with each other so that penetration of, for example, the green conductor in the top cable and the same conductor lying beneath the green conductor in other cables, all of the green conductors will be connectable together.

It will further be recognized that if cables of each of the types illustrated in FIGS. 1, 2 and 3 are assembled with the reference edges aligned and if all of the conductors in each cable are penetrated by an electrical interconnection device, there will be automatic interconnection of the proper ones of the conductors with each other without giving any consideration or thought to which conductors are the proper ones to be connected. Thus, all of the white conductors will be connected together, all of the green conductors will be connected to each other, the black conductor 14 in cable 10 will be connected to black conductor 36 in cable 32 and the red conductor 15 in cable 10 will be connected to the red conductor 26 in cable 22, thereby forming from the 4-conductor cable two 3-conductor branch circuits with the cables of FIGS. 2 and 3.

Figure 6:
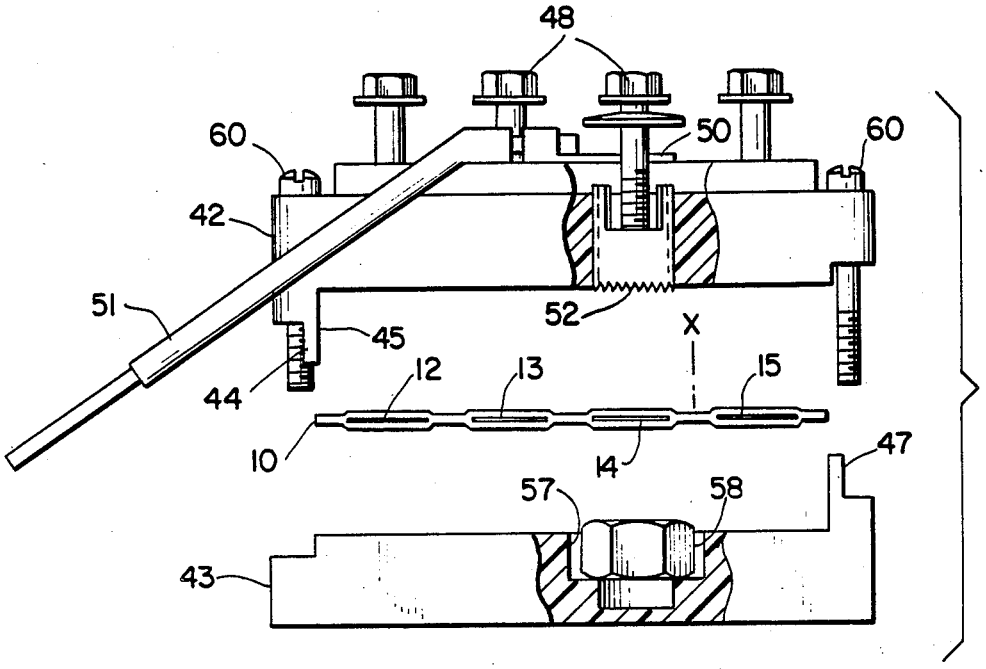
FIG. 6 is an exploded view of a transition assembly with which the cable of the present invention can be used, illustrated in connection with the cable of the first type.

FIG. 6 illustrates a cable of the first type in a position to be engaged by a transition connection assembly of a type which is particularly useful with the cables of the present invention. The transition assembly is more fully described in U.S. Pat. No. 4,602,840, David H. Romatzick, patentee, entitled "Under-Carpet Connection System", which is assigned to the assignee of the present application and the disclosure of which is hereby incorporated by reference. Briefly, the transition assembly includes an upper body 42 of polymeric material and a lower body 43 of similar material. The upper body has a downwardly extending tab 44 with an inner surface 45 which acts as an alignment or reference surface for the cables. The lower body similarly has an upwardly extending tab 47. The bodies are formed with recesses to receive the tab of the other body so that the two bodies, when assembled, are in a predetermined, definite orientation. Upper body 42 has bolts 48 which are threaded into the body and which pass through terminals 50 to connect wires such as wire 51 to the bolts and, ultimately, to the conductors within the cable extending through the opening between the assembled bodies. Each bolt 48 is associated with a puncturing device 52 having teeth at the lower end thereof. The lower end of each bolt 48 is sharpened so as to be capable of penetrating the insulation and the conductor of a flat cable.

The lower body is provided with a plurality of recesses 57 each containing an internally threaded nut 58 which acts as a backing member and which receives the threaded end of its associated bolt 48 after penetration of the intervening conductor.

The upper body is also provided with attachment bolts 60 which can be threaded into suitable openings in the lower body 43 to hold bodies 42 and 43 together while bolts 48 are being rotated to cause them to penetrate the conductors in the cable. It should further be noted that bolts 48 are longitudinally offset in a staggered pattern so that they can remain aligned with the conductors in the flat cable and still have sufficient spacing between them to comply with the electrical code and to avoid any possibility of arcing at rated voltages and currents.

When the bodies 42 and 43 are assembled together with bolts 60 and bolts 48 are rotated to cause them to penetrate the conductors and engage the backing nuts 58, puncturing members 52 puncture the upper insulation of the flat conductors and make good electrical contact therewith, the upper ends of the puncturing members being in contact with terminals 50 surrounding the unthreaded portions of bolts 48. The wires such as wires 51 are thus in electrical contact with the flat cable and power can be supplied in either direction, from the flat cable to the wires or vice versa. If an assembly such as that shown in FIG. 6 is to be used in connection with a cable of the type shown in FIG. 2, the conductor in the position of FIG. 4 is missing and the wires connected to bolts 48 are simply connected to the other three conductors in the manner described. If a conductor of the type shown in FIG. 3 is placed in the assembly, the reference edge thereof is placed adjacent surface 45 and the other edge extends approximately to the position of the letter X shown in FIG. 6. Thus, there is no conductor or cable portion in the position of conductor 15. Again, bolts 48 are threaded through to penetrate the conductors and the wires are again connected as in a branch circuit to the white, green and black conductors of the flat cable.

As will be recognized from the above, the positioning of the conductors within the cable types and the utilization of these cable types with each other permit a variety of interconnection situations to be accomplished with ease and with minimum likelihood of incorrect interconnection. The interconnection of one flat cable with another, as previously suggested, can be accomplished in a relatively simple manner with an apparatus as shown in FIG. 6 and with the addition of an intermediate member between flat cables to puncture the insulation on both cables, thereby establishing connection therebetween without relying upon bolt 48 itself. This is more fully described in the copending Romatzick application mentioned above. As will be recognized, utilization of the cable disclosed herein can conserve as much as 25% of the copper which would otherwise be used in the branch circuits with attendant savings and convenience as well as minimized likelihood of incorrect connection.

While certain advantageous embodiments have been chosen to illustrate the invention it will be understood by those skilled in the art that various changes and modifications can be made therein without departing from the scope of the invention as defined in the appended claims.

What I claim is:

1. A flat conductor cable connection system comprising a transition connection device having an opening to receive flat conductor cables, a reference surface at one side of said opening and four electrically conductive connectors movably supported in said connection device in uniformly spaced relationship;

first and second flat conductor cables each having a reference edge and a width selected to be receivable in said connection device, said first cable including a longitudinally extending grounded circuit flat conductor positioned in said cable in a color-coded W position relative to said reference edge, a longitudinally extending equipment grounding flat conductor positioned in said cable in a color-coded G position relative to said reference edge, a longitudinally extending first ungrounded flat conductor positioned in said cable in a color-coded B position relative to said reference edge, a longitudinally extending second ungrounded flat conductor positioned in said cable in a color-coded R position relative to said reference edge, said conductor in said G position being between said W and R positions; and said second cable comprising first and second longitudinally extending flat conductors in the same positions relative to said reference edge as said W and G positions in said first cable and a third flat conductor in the one of said R and B positions with the other of said R and B positions being vacant, said reference edges of said two cables of said cable types being positioned adjacent the reference surface of said transition connection device with said conductors of both said first and second cables aligned with and interconnected by said conductive connectors.

2. A wiring system comprising a transition connection device including a housing;

means in said housing defining an opening for receiving and interconnecting a plurality of flat cables, said means including a reference surface at one side of said opening, and four electrically conductive members supported in said housing, said members being uniformly, laterally spaced apart;

a cable of a first cable type in said opening, said first cable type having four flat, spaced-apart conductors therein, said conductors being covered with insulation material and having substantially the same lateral center-to-center spacing as said conductive members, said first cable having a reference edge adjacent a first one of said conductors and positioned adjacent said surface;

a cable of a second cable type in said opening, said second cable type having three flat spaced-apart conductors therein, said conductors being covered by insulation material, the first and second of said conductors having substantially the same lateral center-to-center spacing as said conductive members, the third of said conductors being laterally spaced from the second conductor by twice the center-to-center spacing of said first and second conductors, said second cable having a reference edge adjacent the first of said conductors and positioned adjacent said surface;

cable of a third cable type having three flat spaced-apart conductors therein, said conductors being covered with insulation material, said three conductors having substantially the same center-to-center lateral spacing as said cable of said first type, said cable of said third type having a reference edge adjacent the first of said conductors and positioned at said surface so that said conductors of both said first and second cables similarly spaced from said reference edges are aligned with each other, said conductive members extending into and electrically interconnecting aligned ones of said conductors in said cables.

3. A system in accordance with claim 2 wherein the outer surface of said insulation of each cable type includes color code indicia identifying said first conductor adjacent said reference edge in each of said cable types as a white conductor, the second conductor in each of said cable types as a green conductor, the third conductor in each of said first and third cable types as a black conductor and the fourth conductor in each of said first and second cable types as a red conductor.

4. A wiring system comprising a transition connection device including a housing;

means in said housing defining an opening for receiving and interconnecting a plurality of flat cables, said means including a reference surface at one side of said opening, and four electrically conductive members supported in said housing, said members being uniformly, laterally spaced apart;

a cable of a first cable type in said opening, said first cable type having four flat, spaced-apart conductors therein, said conductors being covered with insulation material and having substantially the same lateral center-to-center spacing as said conductive members, said first cable having a reference edge adjacent a first one of said conductors and positioned adjacent said surface; and a cable of a second cable type in said opening, said second cable type having three flat spaced-apart conductors therein, said conductors being covered by insulation material, the first and second of said conductors having substantially the same lateral center-to-center spacing as said conductive members, the third of said conductors being laterally spaced from the second conductor by twice the center-to-center spacing of said first and second conductors, said second cable having a reference edge adjacent the first of said conductors and positioned adjacent said surface so that conductors similarly spaced from said reference edges are aligned with each other, said conductive members extending into and electrically interconnecting aligned ones of said conductors in said cables.

5. A system in accordance with claim 4 wherein the outer surface of said insulation of each cable type includes color code indicia identifying said first conductor adjacent said reference edge in each of said cable types as a white conductor, the second conductor in each of said cable types as a green conductor, the third conductor in said first cable type as a black conductor and the third conductor in said second cable type as a red conductor.

* * * * *